US007832447B2

(12) United States Patent
Yang

(10) Patent No.: US 7,832,447 B2
(45) Date of Patent: Nov. 16, 2010

(54) SPECIFICATION-ATTACHING APPARATUS

(75) Inventor: Sheng-Hui Yang, Taichung (TW)

(73) Assignee: CVC Technologies, Inc., Taichung Hsien (TW)

( * ) Notice: Subject to any disclaimer, the term of this patent is extended or adjusted under 35 U.S.C. 154(b) by 182 days.

(21) Appl. No.: 12/182,312

(22) Filed: Jul. 30, 2008

(65) Prior Publication Data

US 2010/0024989 A1 Feb. 4, 2010

(51) Int. Cl.
*B65C 9/18* (2006.01)

(52) U.S. Cl. ..... 156/566; 156/556; 156/569; 156/570; 221/233; 221/236; 221/251

(58) Field of Classification Search ..... 156/556, 156/566, 569, 570; 221/233, 236, 251
See application file for complete search history.

(56) References Cited

U.S. PATENT DOCUMENTS 3,542,243 A * 11/1970 Stockdale ..... 221/236
6,993,887 B2 * 2/2006 Dharssi et al. ..... 156/DIG. 31
2002/0185232 A1 * 12/2002 Draghetti et al. ..... 156/556

* cited by examiner

*Primary Examiner*—Khanh Nguyen
*Assistant Examiner*—John Blades
(74) *Attorney, Agent, or Firm*—McNees Wallace & Nurick, LLC

(57) ABSTRACT

A specification-attaching apparatus includes a transferring unit for transferring a specification fed from a specification-feeding unit to an attaching unit that includes a suction member movable, in response to rotation of a pivot rod, in sequence among angularly spaced sucking, standby and releasing positions. The suction member is operable so as to switch from a non-sucking state to a sucking state when at the sucking position, thereby sucking the specification transferred from the transferring unit and to switch from the sucking state to the non-sucking state when at the releasing position, thereby releasing the specification sucked thereby. A container sprayed with glue by a glue-spraying unit is conveyed by a motor-driven container conveying unit to move in synchronization with and contact the suction member during movement of the suction member from the standby position to the releasing position so that the specification is attached to the container.

6 Claims, 10 Drawing Sheets

SPECIFICATION-ATTACHING APPARATUS

BACKGROUND OF THE INVENTION

1. Field of the Invention

The invention relates to a specification-attaching apparatus, more particularly to a specification-attaching apparatus for attaching a specification to a container.

2. Description of the Related Art

Referring to FIG. 1, a container 11, such as a drug bottle, is generally attached with a label 12 by a conventional labeling machine. The label 12 is used to classify products, to indicate usage, to display the trademark or logo of the manufacturer, etc. However, an additional specification 13 for indicating other product information is attached manually to the container 11, thereby resulting in relatively high costs.

SUMMARY OF THE INVENTION

Therefore, an object of the present invention is to provide a specification-attaching apparatus that can automatically attach a specification to a container.

According to the present invention, a specification-attaching apparatus comprises:

a specification-feeding unit configured with a receiving space adapted for receiving a row of specifications therein, and operable so as to feed one of the specifications outwardly of the receiving space;

a transferring unit adapted for transferring said one of the specifications fed from the specification-feeding unit to a first position;

an attaching unit disposed adjacent to the transferring unit and including a pivot rod, and at least one first suction member movable, in response to rotation of the pivot rod, in sequence among a sucking position adjacent to the first position, a standby position and a releasing position that are spaced angularly apart from each other, the first suction member of the attaching unit being operable between a sucking state and a non-sucking state, wherein the first suction member of the attaching unit is switched from the non-sucking state to the sucking state when the first suction member of the attaching unit is at the sucking position such that said one of the specifications transferred from the transferring unit is sucked thereby, and is switched from the sucking state to the non-sucking state when the first suction member of the attaching unit is at the releasing position such that said one of the specifications is released therefrom;

a motor-driven container conveying unit disposed adjacent to the standby position and the releasing position, having a feed-in end adjacent to the standby position, and a take-out end adjacent to the releasing position, and adapted to convey a container from the feed-in end to the take-out end, the container conveying unit being operable so that the container conveyed thereby moves in synchronization with the first suction member of the attaching unit and contacts said one of the specifications sucked by the first suction member of the attaching unit when the first suction member of the attaching unit moves from the standby position to the releasing position; and a glue-spraying unit disposed adjacent to the container conveying unit and between the feed-in end of the container conveying unit and the standby position, and adapted for spraying glue onto the container conveyed by the container conveying unit before the first suction member of the attaching unit reaches the standby position.

Said one of the specifications sucked by the first suction member of the attaching unit is adhered to the container conveyed by the container conveying unit by the glue during movement of the first suction member of the attaching unit from the standby position to the releasing position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
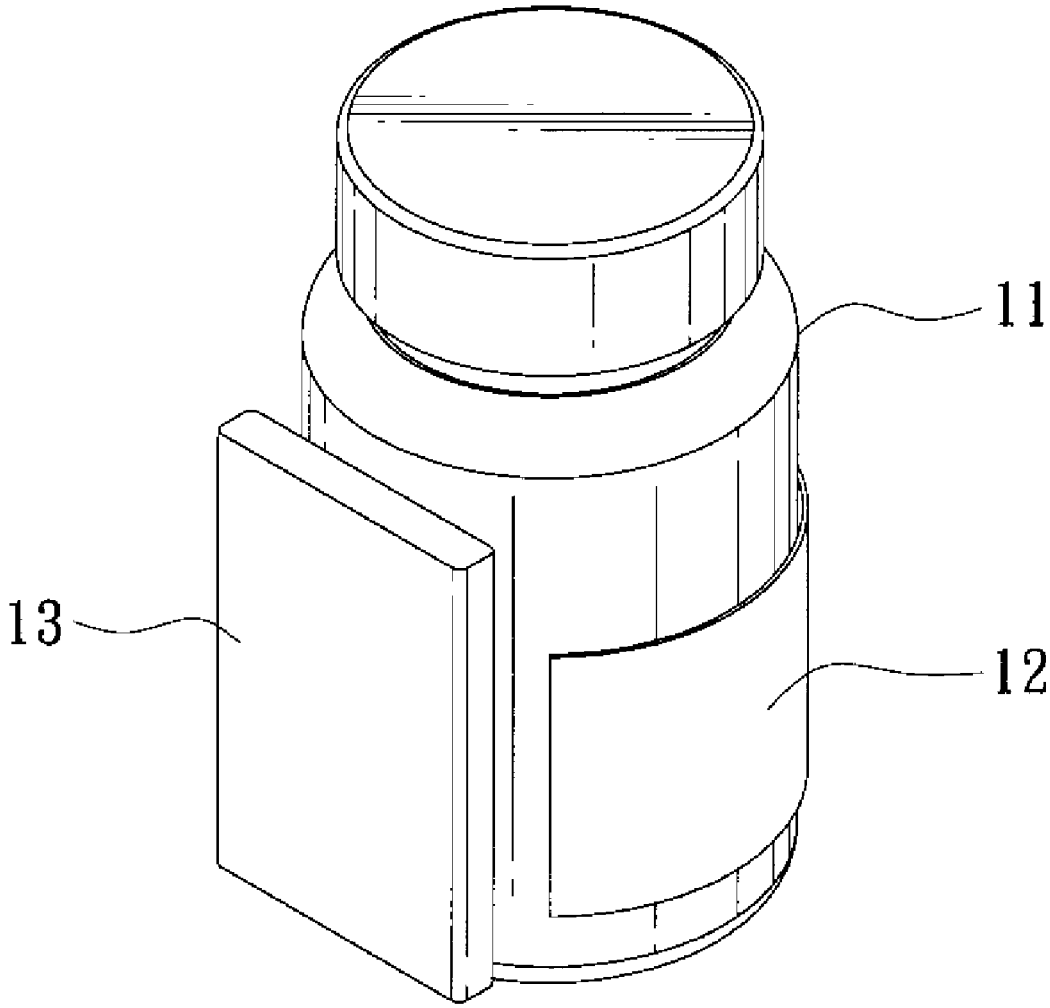
FIG. 1 PRIOR ART
FIG. 1 is a perspective view showing a container attached with a label and a specification thereon.
Figure 2:
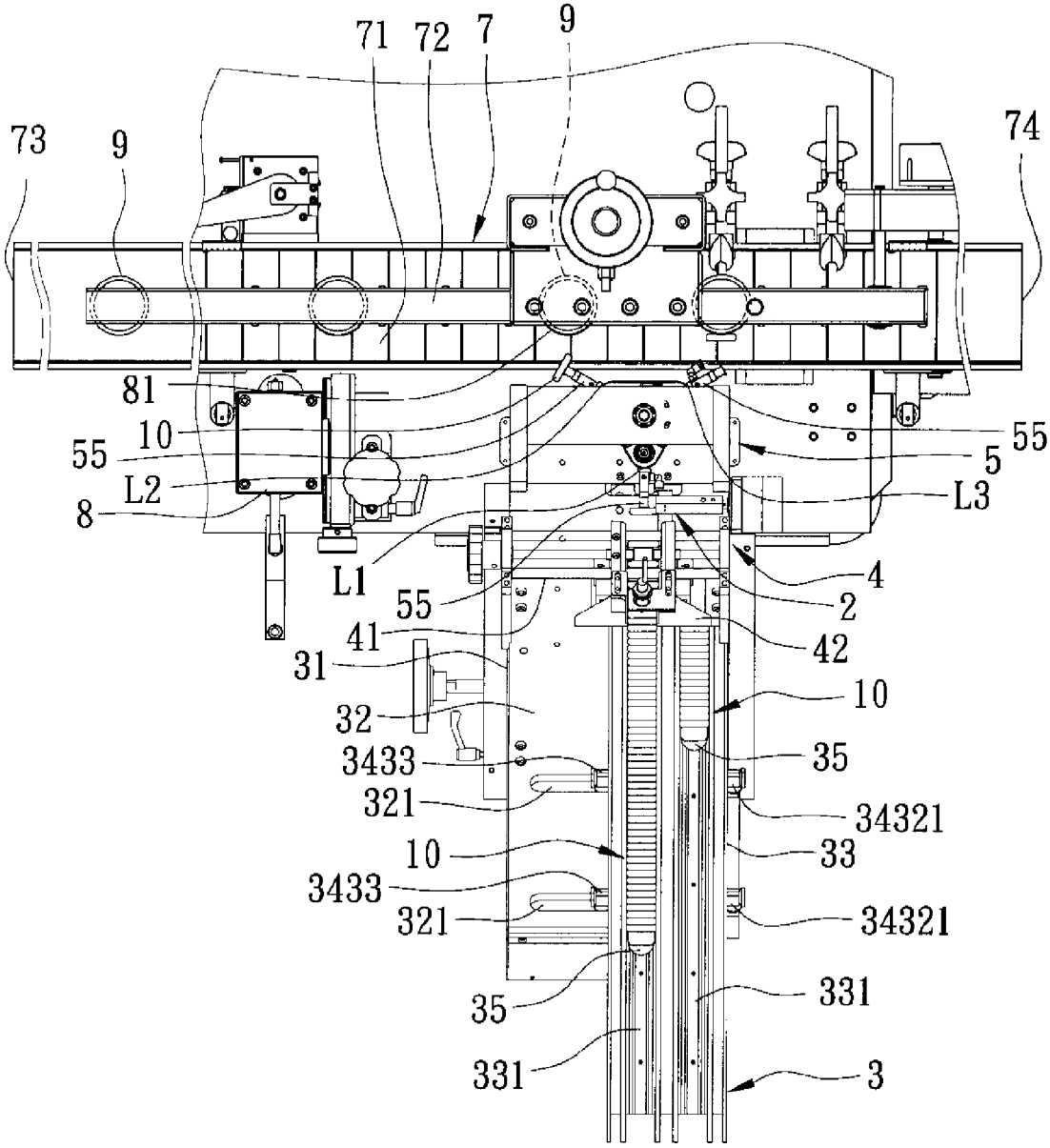
FIG. 2 is a schematic top view showing the preferred embodiment of a specification-attaching apparatus according to the present invention.
Figure 3:
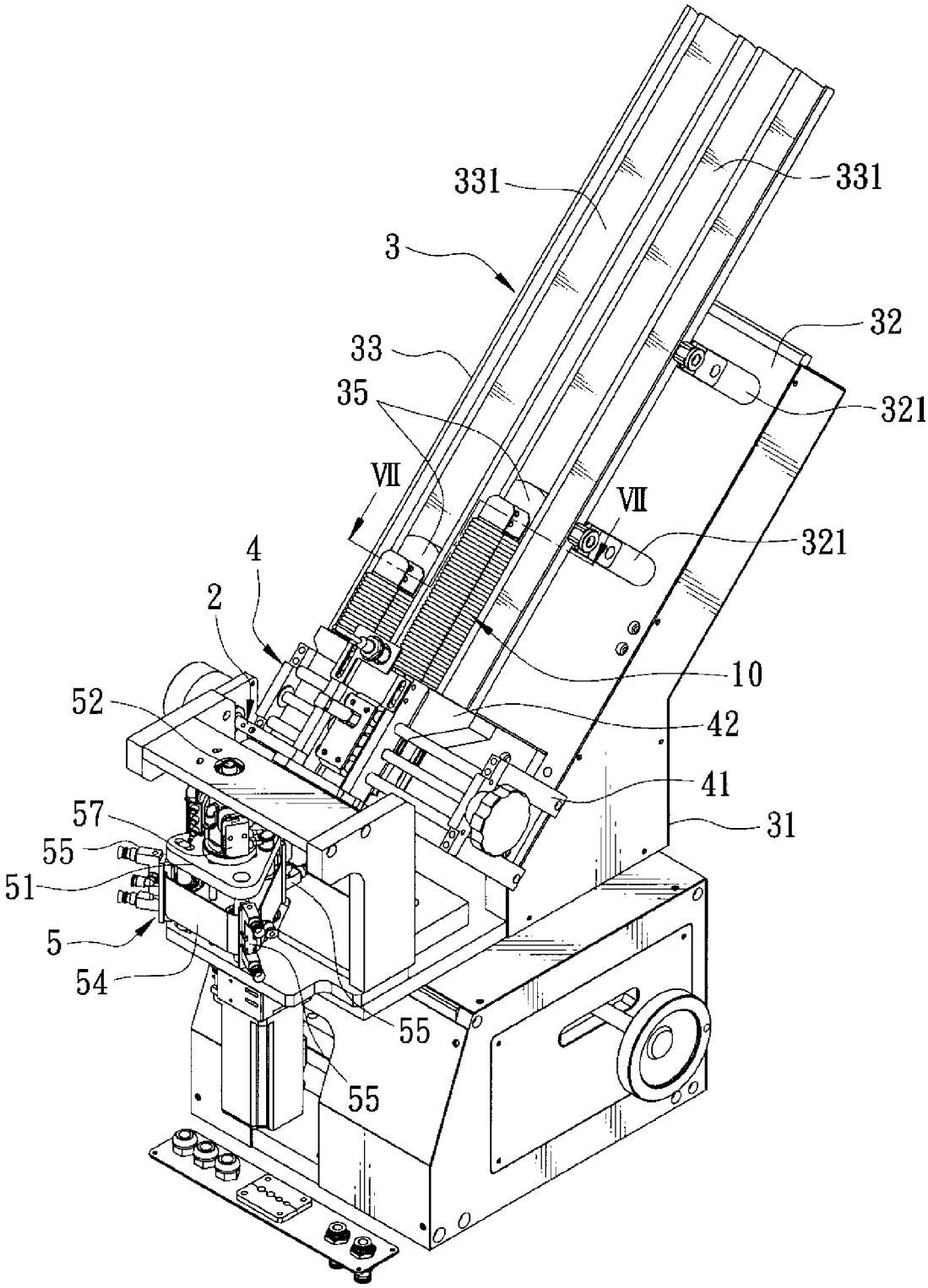
FIG. 3 is a perspective view showing the preferred embodiment without a container conveying unit and a glue-spraying unit.

Referring to FIGS. 2 and 3, the preferred embodiment of a specification-attaching apparatus according to the present invention is shown to include a specification-feeding unit 4, a specification storage unit 3, a transferring unit 2, an attaching unit 5, a motor-driven container conveying unit 7, and a glue-spraying unit 8.

The specification-feeding unit 4 is configured with a receiving space 40 adapted for receiving a row of specifications 10 therein, and is operable so as to feed one of the specifications 10 outwardly of the receiving space 40. In this embodiment, referring further to FIGS. 4 and 5, the specification-feeding unit 4 includes a frame 41, a pair of first blocking members 44, a pair of second blocking members 43, a set of first hydraulic cylinders 45 (only one is shown), and a set of second hydraulic cylinders 46 (only one is shown). The frame 41 is formed with the receiving space 40, and an upper inlet 401 and a lower outlet 402 in spatial communication with the receiving space 40. The first blocking members 44 are spaced apart from each other and are mounted movably to the frame 41. Each first blocking member 44 has a blocking end portion 440 disposed adjacent to the outlet 402 in the frame 41. The first blocking members 44 are operable so that the blocking end portions 440 of the first blocking members 44 move toward and away from each other. The second blocking members 43 are spaced apart from each other and are mounted movably to the frame 41. Each second blocking member 43 has a blocking end portion 430, which consists of two plate bodies spaced apart from each other in this embodiment, disposed distal from the outlet 402 in the frame 41. The second blocking members 43 are operable so that the blocking end portions 430 of the second blocking members 43 move toward and away from each other. The first hydraulic cylinders 45, such as pneumatic cylinders, are mounted on the frame 41 for driving the first blocking members 44. The second hydraulic cylinders 46, such as pneumatic cylinders, are mounted on the frame 41 for driving the second blocking members 43.

Figure 4:
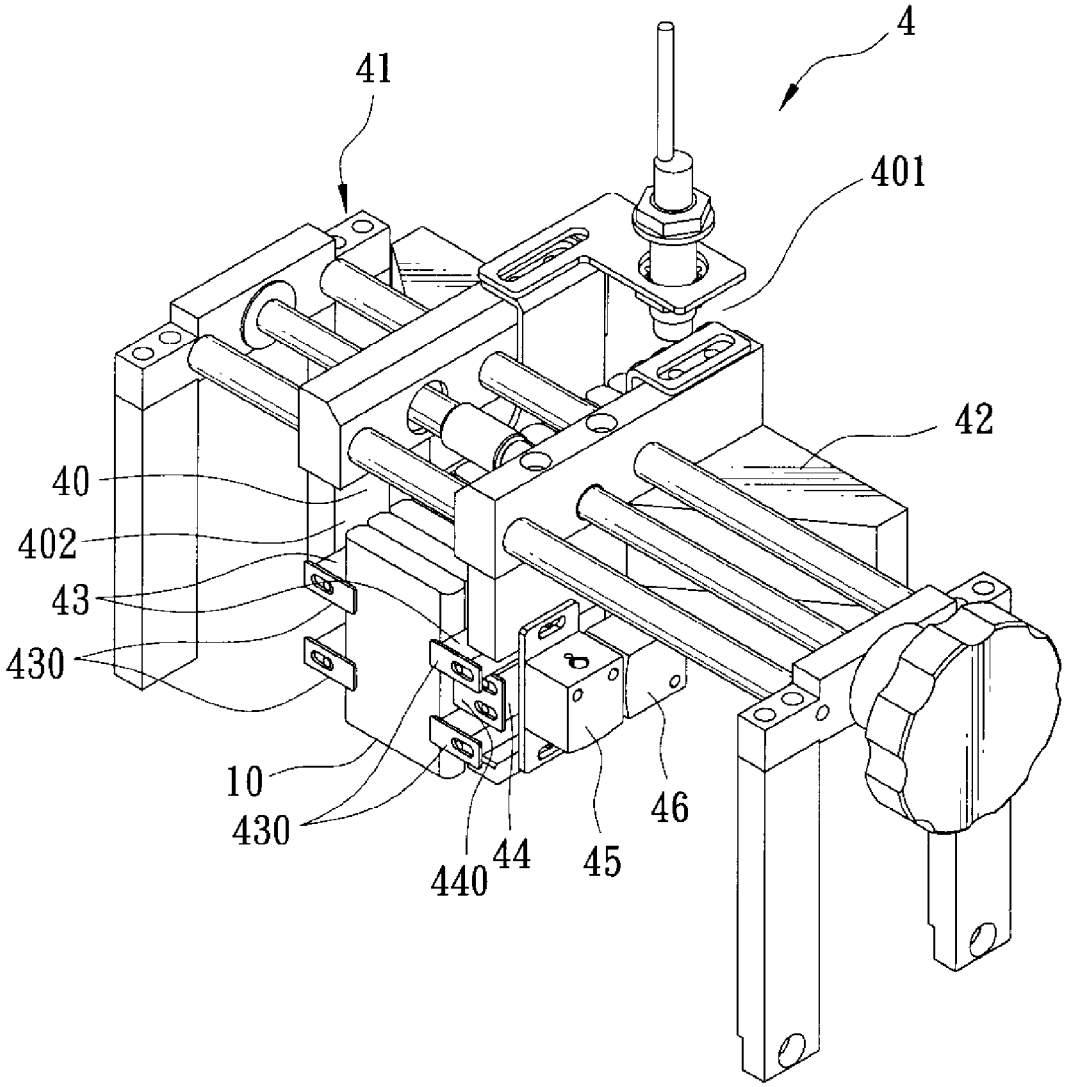
FIG. 4 is a perspective view showing a specification-feeding unit of the preferred embodiment.
Figure 5:
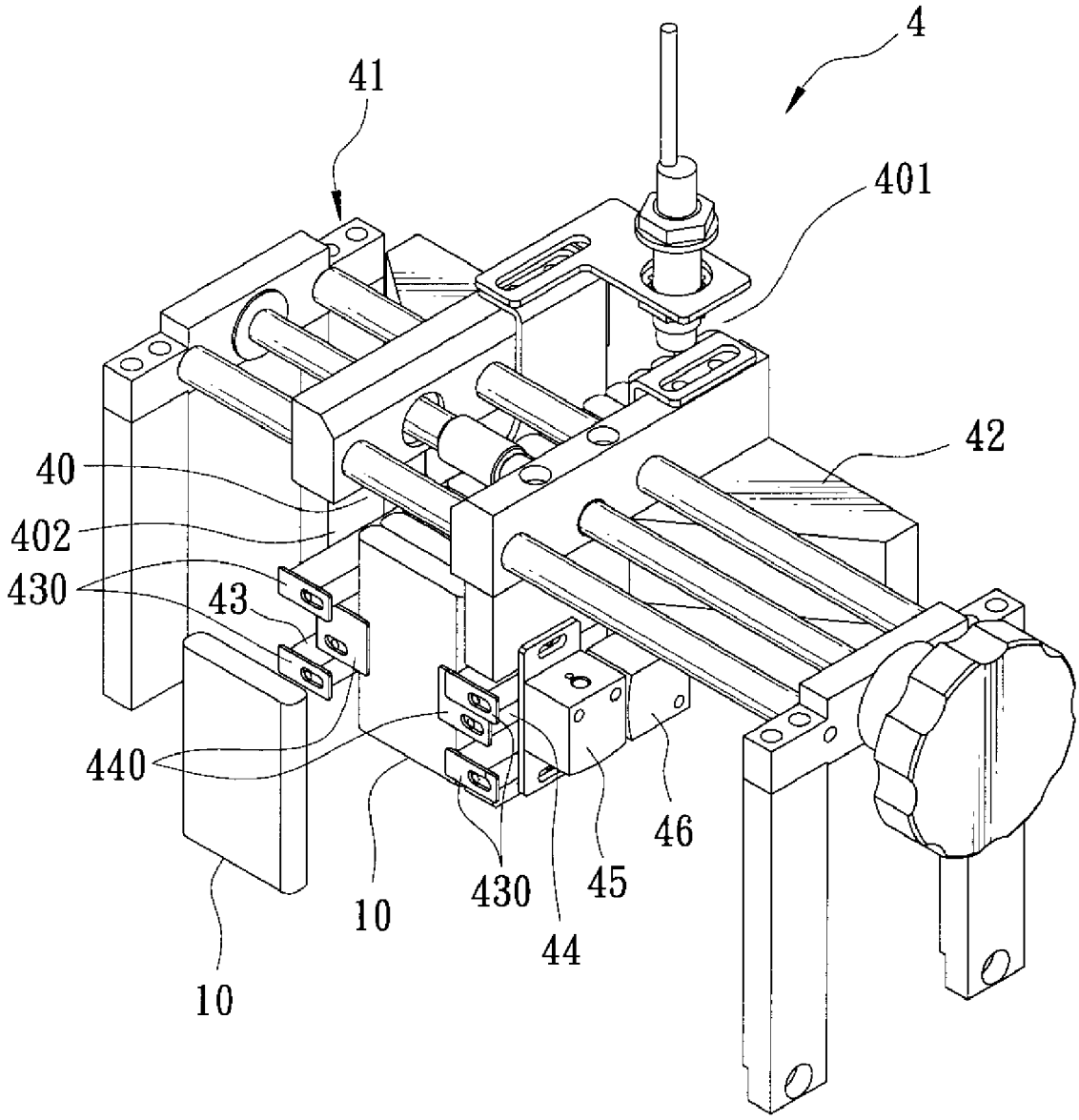
FIG. 5 is a perspective view illustrating how the specification-feeding unit of the preferred embodiment feeds a specification.

In operation, when the blocking end portions 440 of the first blocking members 44 move toward each other, said one of the specifications 10 received in the receiving space 40 is blocked by the blocking end portions 440 of the first blocking members 44. When the blocking end portions 440 of the first blocking members 44 move away from each other while the blocking end portions 430 of the second blocking members 43 move toward each other, said one of the specifications 10 received in said receiving space 40 in the frame 41 is released from the blocking end portions 440 of the first blocking members 44, moves outwardly of the receiving space 40 in the frame 41, and is blocked by the blocking end portions 430 of the second blocking members 43, as shown in FIG. 4. Thereafter, when the blocking end portions 430 of the second blocking members 43 move away from each other, said one of the specifications 10 is released from the blocking end portions 430 of the second blocking members 43, thereby feeding said one of the specifications 10, as shown in FIG. 5. It is noted that, at the same time, the blocking end portions 440 of the first blocking members 44 move toward each other again, thereby blocking an adjacent one of the specifications 10 to be fed from the transferring unit 2 (see FIG. 5). Furthermore, the frame 41 further has an upper stop block 42 formed with the inlet 401 (see FIGS. 4 and 5).

The specification storage unit 3 is configured with an accommodating groove unit adapted for receiving at least one row of specifications 10 therein, and in spatial communication with the inlet 401 in the frame 41 of the specification-feeding unit 4 such that the specifications 10 received in the accommodating groove unit are supplied into the receiving space 40 in the frame 41 of the specification-feeding unit 4 via the inlet 401 in the frame 41. In this embodiment, the specification storage unit 3 includes a base 31, a groove-defining seat 33, a driving member 34, and two loading members 35. The base 31 has an inclined top wall 32. The groove-defining seat 33 is mounted movably on the top wall 32 of the base 31, is disposed adjacent to the upper stop block 42 of the specification-feeding unit 4, and has the accommodating groove unit that includes two parallel accommodating grooves 331, each of which is adapted for receiving a row of the specifications 10 therein, as shown in FIG. 3.

Figure 6:
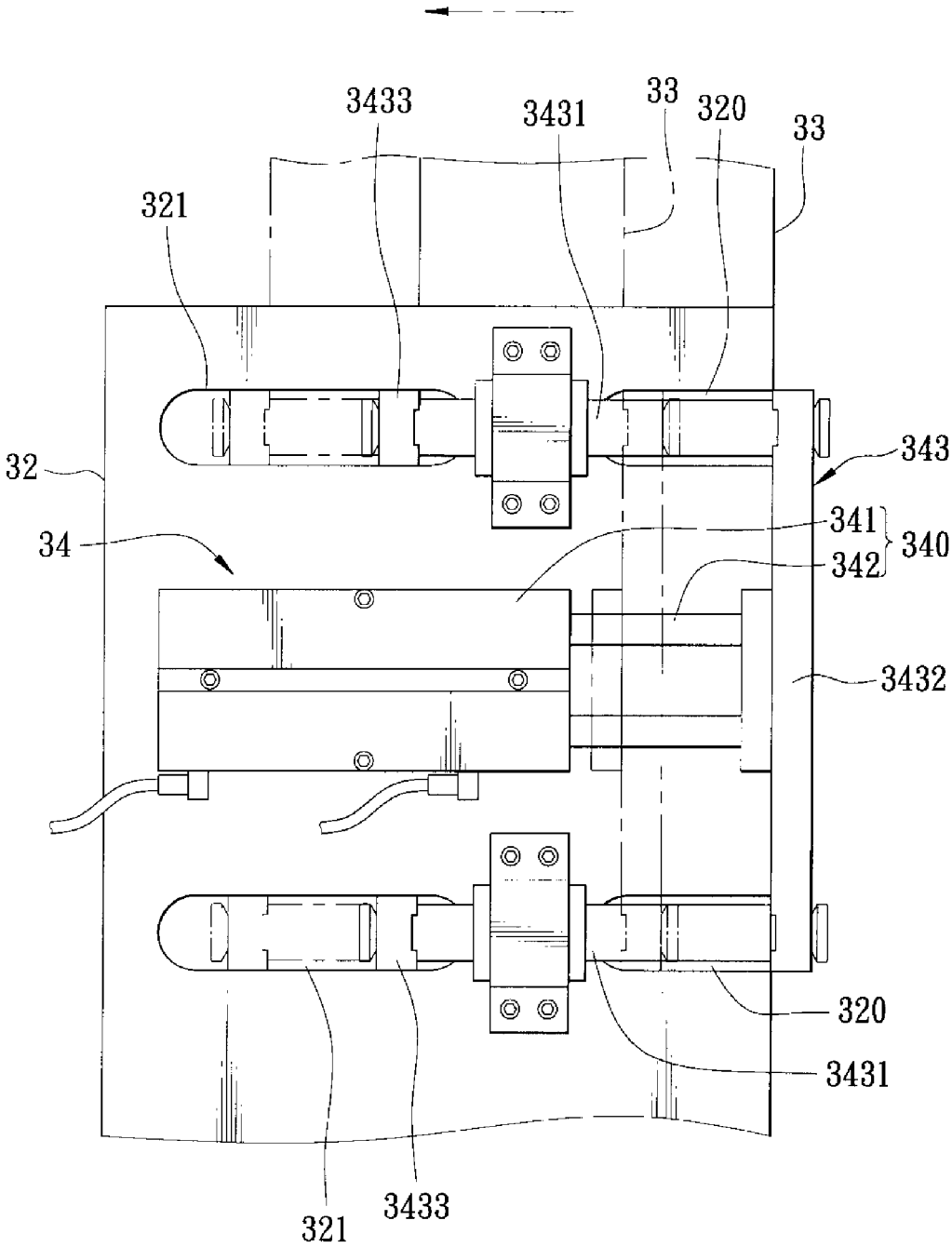
FIG. 6 is a fragmentary schematic bottom view showing a specification storage unit of the preferred embodiment.

Referring further to FIG. 6, the driving member 34 is mounted to the base 31 for driving the groove-defining seat 33 to move relative to the base 31 so that one of the accommodating grooves 331 of the accommodating groove unit is in spatial communication with the inlet 401 in the upper stop block 42 of the frame 41 of the specification-feeding unit 4 while the other one of the accommodating grooves 331 of the accommodating groove unit is blocked by the upper stop block 42 of the frame 41. In this embodiment, the driving member 34 includes a hydraulic cylinder 340 and a connecting member 343. The hydraulic cylinder 340, such as a pneumatic cylinder, has a cylinder body 341 mounted on a bottom surface of the top wall 32 of the base 31, and a piston rod portion 342 connected movably to the cylinder body 341. The connecting member 343 interconnects the piston rod portion 342 and the groove-defining seat 33. The connecting member 343 includes two parallel first rod bodies 3431 spaced apart from each other, a second rod body 3432 having opposite ends connected respectively ends of the first rod bodies 3432 and having projections 34321 that project upwardly through two first slots 320 in the top wall 32 and that are connected to a lateral side of the groove-defining seat 33 (see FIG. 2), and two connecting blocks 3233 connected respectively to the other ends of the first rod bodies 3431 (see FIG. 6), extending upwardly through two second slots 431 in the top wall 32 and connected to the other lateral side of the groove-defining seat 33 (see FIG. 2).

Figure 7:
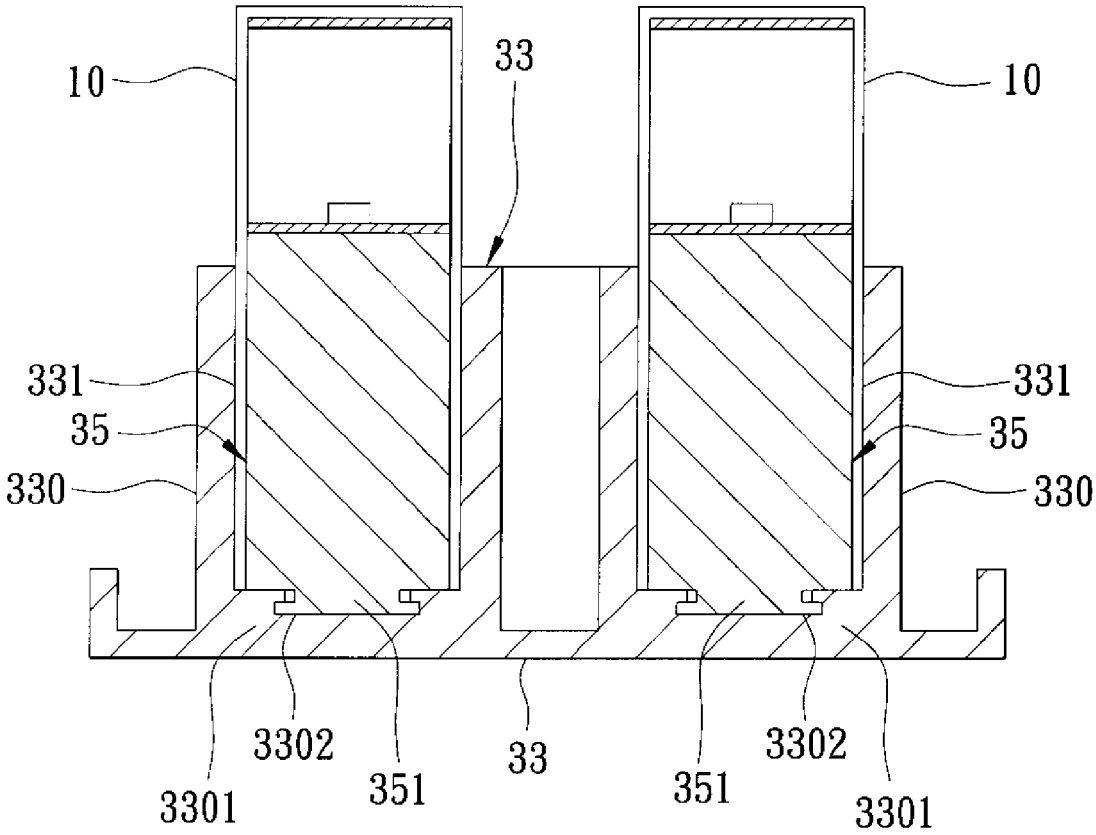
FIG. 7 is a schematic sectional view of a groove-defining seat and loading members of the specification storage unit taken along line VII-VII in FIG. 3.

The loading members 35 are mounted on the groove-defining seat 33, are disposed movably in a corresponding one of the accommodating grooves 331 of the accommodating groove unit, and are adapted to press downwardly the specifications 10 received in the corresponding one of the accommodating grooves 331 of the accommodating groove unit. Referring further to FIG. 7, each accommodating groove 331 of the accommodating groove unit is defined by a U-shaped wall 330 that has a groove-bottom wall portion 3301 formed with a dovetail groove 3302. Each loading member 35 has a dovetail projection 351 engaging movably the dovetail groove 3302 in the groove bottom wall portion 3301 of the U-shaped wall 330 defining a corresponding one of the accommodating grooves 331 of the accommodating groove unit.

Figure 8:
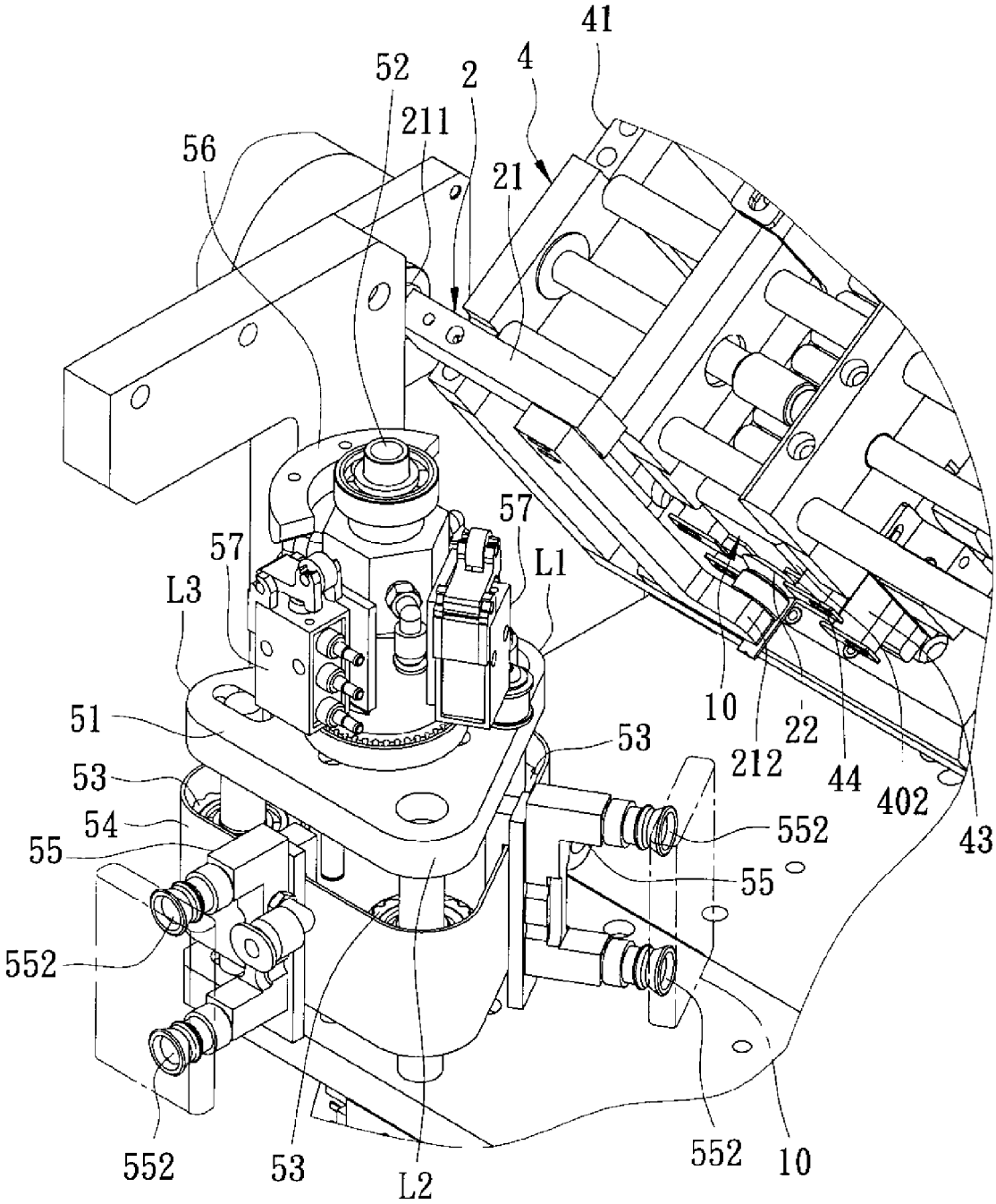
FIG. 8 is a fragmentary perspective view showing the specification-feeding unit, a transferring unit and an attaching unit of the preferred embodiment.
Figure 9:
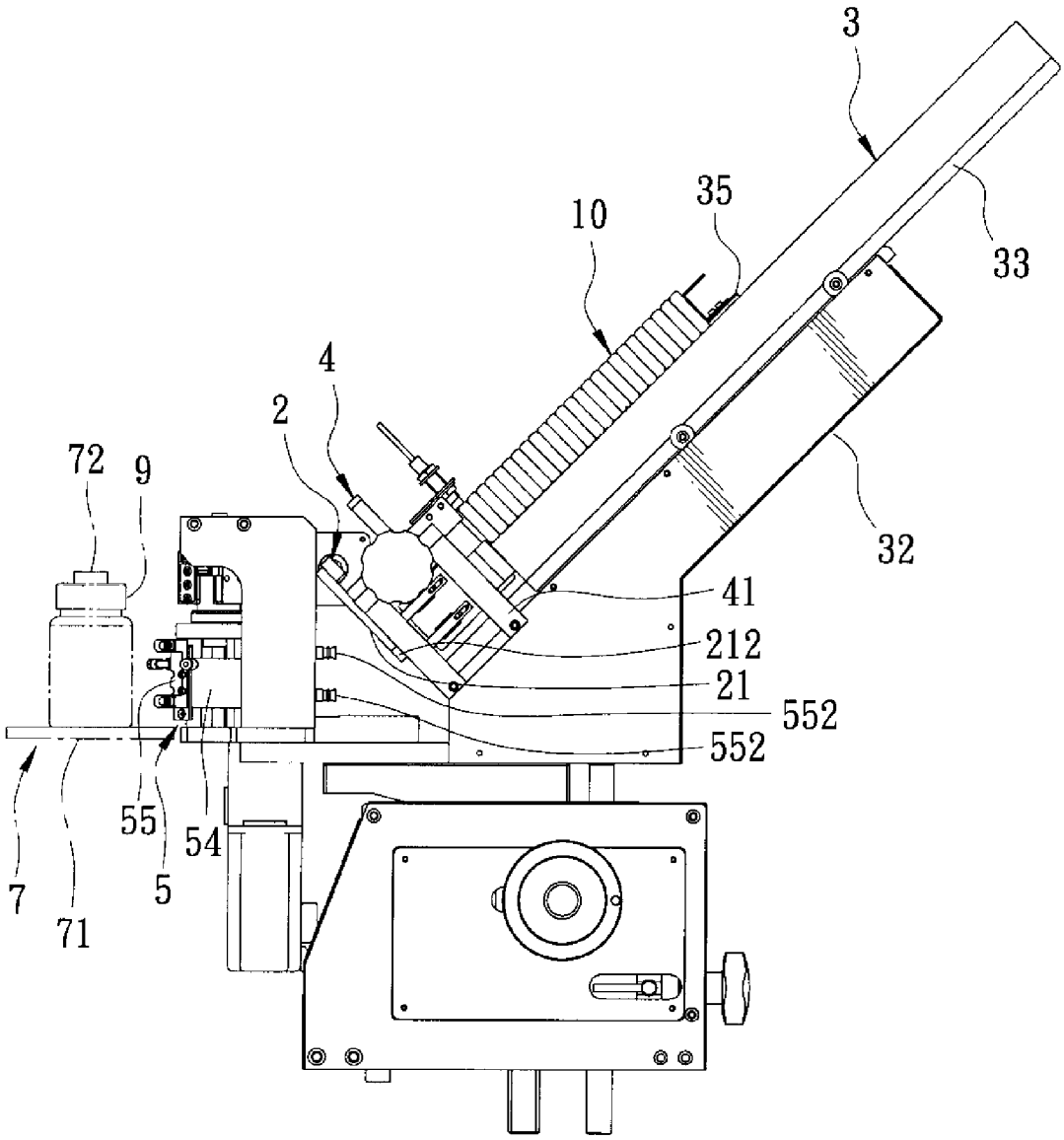
FIGS. 9 and 10 are schematic side views illustrating operation of the transferring unit of the preferred embodiment.
Figure 10:
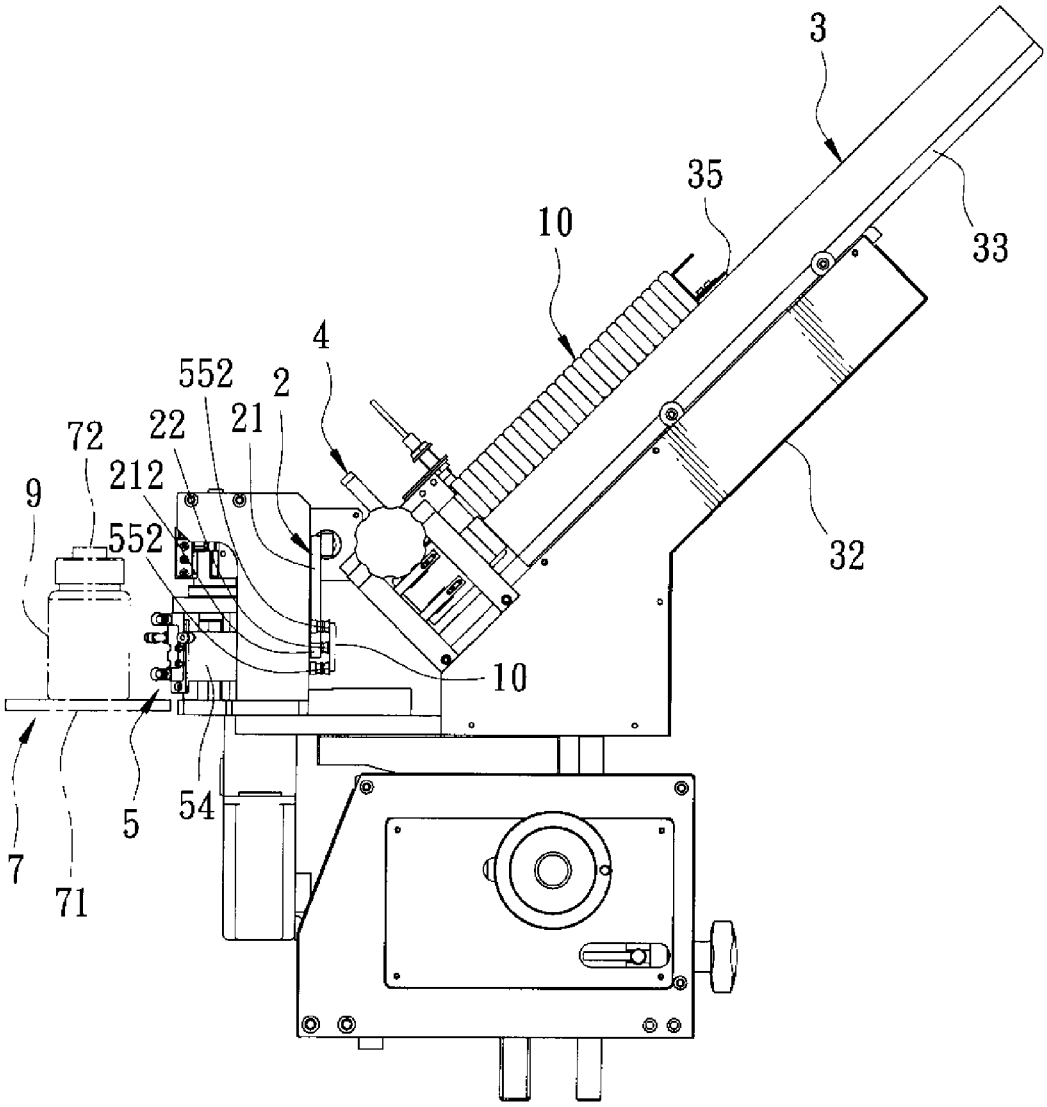

Referring further to FIGS. 8 to 10, the transferring unit 2 is adapted for transferring said one of the specifications 10 fed from the specification-feeding unit 4 to a first position. In this embodiment, the transferring unit 2 includes a pivot arm 21 and a second suction member 22. The pivot arm 21 has a pivot end 211 connected pivotally to the frame 41 of the specification-feeding unit 4, and a free end 212 opposite to the pivot end 211, as best shown in FIG. 8. The pivot arm 21 is operable so that the free end 212 moves between the first position (see FIG. 10), and a second position adjacent to the outlet 402 in the frame 41 of the specification-feeding unit 4 (see FIG. 9). The second suction member 22 is mounted on the free end 212 of the pivot arm 21, and is operable between a sucking state and a non-sucking state, wherein the second suction member 22 is switched from the non-sucking state to the sucking state when the free end 212 of the pivot arm 21 is at the second position such that said one of the specifications 10 fed from the specification-feeding unit 4 is sucked thereby, and is switched from the sucking state to the non-sucking state when the free end 212 of the pivot arm 21 is at the first position such that said one of the specifications 10 is released therefrom.

As shown in FIG. 8, the attaching unit 5 is disposed adjacent to the transferring unit 2. In this embodiment, the attaching unit 5 includes a regular triangular mounting seat 51, a pivot rod 52, a transmission wheel unit 53, a transmission belt 54, three first suction members 55, an actuating member 56, and three sensors 57.

The mounting seat 51 has three corners corresponding respectively a sucking position (L1) adjacent to the first position, a standby position (L2) and a releasing position (L3). The pivot rod 52 is journalled on the mounting seat 51. The transmission wheel unit 53 is disposed rotatably in the mounting seat 51. The transmission belt 54 is trained on the transmission wheel unit 53, surrounds around the mounting seat 51, and is driven by the transmission wheel unit 53 in response to rotation of the pivot rod 52. The first suction members 55 are mounted spacedly on the transmission belt 54, and are angularly equidistant. As a result, each first suction member 55 is movable, in response to 15 rotation of the pivot rod 52, in sequence among the sucking position (L1), the standby position (L2) and the releasing position (L3). Each first suction member 55 has two suckers 552, and is operable between a sucking state and a non-sucking state, wherein each first suction member 55 is switched from the non-sucking state to the sucking state when a corresponding one of the first suction members 55 is at the sucking position (L1) while the free end 212 of the pivot arm 21 of the transferring unit 2 is at the first position such that said one of the specifications 10 transferred from the transferring unit 2 and, more specifically, released from the second suction member 22 is sucked thereby, and is switched from the sucking state to the non-sucking state when the corresponding one of the first suction members 55 is at the releasing position (L3) such that said one of the specifications 10 is released therefrom. The actuating member 56 extends between the releasing position (L3) and the sucking position (L1). The sensors 57 are mounted spacedly on the pivot rod 52, are angularly equidistant, and correspond respectively to the first suction members 55. Each sensor 57 is activated by the actuating member 56 when a corresponding one of the first suction members 55 is at the releasing position (L3), and is deactivated when the corresponding one of the first suction members 55 is at the sucking position (L1). Thus, each first suction member 55 is operated in the non-sucking state during activation of a corresponding one of the sensors 57 and in the sucking state during deactivation of the corresponding one of the sensors 57.

As shown in FIG. 2, the container conveying unit 7 is disposed adjacent to the standby position (L2) and the releasing position (L3), has a feed-in end 73 adjacent to the standby position (L2), and a take-out end 74 adjacent to the releasing position (L3), and is adapted to convey a container 9 from the feed-in end 73 to the take-out end 74. The container conveying unit 7 is operable so that the container 9 conveyed thereby moves in synchronization with a corresponding one of the first suction members 55 of the attaching unit 5 and contacts said one of the specifications 10 sucked by the corresponding one of the first suction members 55 of the attaching unit 5 when the corresponding one of the first suction members 55 of the attaching unit 5 moves from the standby position (L2) to the releasing position (L3). In this embodiment, the container conveying unit 7 includes a lower conveying belt 71, and an upper conveying belt 72 movable in synchronization with the lower conveying belt 71 such that the container 9 is clamped between the lower and upper conveying belts 71, 72, as shown in FIGS. 9 and 10.

As shown in FIG. 2, the glue-spraying unit 8 is disposed adjacent to the container conveying unit 7 and between the feed-in end 73 of the container conveying unit 7 and the standby position (L2), and is adapted for spraying glue 81 onto the container 9 conveyed by the container conveying unit 7 before the corresponding one of the first suction members 55 of the attaching unit 5 reaches the standby position (L2).

In such a configuration, said one of the specifications 10 sucked by the corresponding one of the first suction members 55 of the attaching unit 5 is adhered to the container 9 conveyed by the container conveying unit 7 by the glue 81 during movement of the corresponding one of the first suction members 55 of the attaching unit 5 from the standby position (L2) to the releasing position (L3). Subsequently, said one of the specifications 10 adhered to the container 9 is released from the corresponding one of the first suction members 55 of the attaching unit 5 that is operated in the non-sucking state when at the releasing position (L3) in response to the activation of a corresponding one of the sensors 57. As such, the container 9 attached with said one of the specifications 10 is obtained at the take-out end 74 of the container conveying unit 7.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A specification-attaching apparatus comprising:

a specification-feeding unit configured with a receiving space adapted for receiving a row of specifications therein, and operable so as to feed one of the specifications outwardly of said receiving space;

a transferring unit adapted for transferring said one of the specifications fed from said specification-feeding unit to a first position;

an attaching unit disposed adjacent to said transferring unit and including a pivot rod, and at least one first suction member movable, in response to rotation of said pivot rod, in sequence among a sucking position adjacent to the first position, a standby position and a releasing position that are spaced angularly apart from each other, said first suction member of said attaching unit being operable between a sucking state and a non-sucking state, wherein said first suction member of said attaching unit is switched from the non-sucking state to the sucking state when said first suction member of said attaching unit is at the sucking position such that said one of the specifications transferred from said transferring unit is sucked thereby, and is switched from the sucking state to the non-sucking state when said first suction member of said attaching unit is at the releasing position such that said one of the specifications is released therefrom;

a motor-driven container conveying unit disposed adjacent to the standby position and the releasing position, having a feed-in end adjacent to the standby position, and a take-out end adjacent to the releasing position, and adapted to convey a container from said feed-in end to said take-out end, said container conveying unit being operable so that the container conveyed thereby moves in synchronization with said first suction member of said attaching unit and contacts said one of the specifications sucked by said first suction member of said attaching unit when said first suction member of said attaching unit moves from the standby position to the releasing position; and a glue-spraying unit disposed adjacent to said container conveying unit and between said feed-in end of said container conveying unit and the standby position, and adapted for spraying glue onto the container conveyed by said container conveying unit before said first suction member of said attaching unit reaches the standby position;

wherein said one of the specifications sucked by said first suction member of said attaching unit is adhered to the container conveyed by said container conveying unit by the glue during movement of said first suction member of said attaching unit from the standby position to the releasing position; and wherein said attaching unit further includes:

a regular triangular mounting seat having three corners corresponding respectively to the sucking, standby and releasing positions, said pivot rod being journalled on said mounting seat;

a transmission wheel unit including a plurality of transmission wheels that are disposed rotatable at each of the corners of said mounting seat;

a transmission belt trained on said transmission wheels, surrounding around said mounting seat and driven by said transmission wheel unit in response to rotation of said pivot rod; and three of said first suction members mounted spacedly on said transmission belt and angularly equidistant.

2. The specification-attaching apparatus as claimed in claim 1, wherein:

said specification-feeding unit includes a frame formed with said receiving space, and an upper inlet and a lower outlet in spatial communication with said receiving space, a pair of first blocking members spaced apart from each other and mounted movably to said frame, each of said first blocking members having a blocking end portion disposed adjacent to said outlet in said frame, said first blocking members being operable so that said blocking end portions of said first blocking members move toward and away from each other, and a pair of second blocking members spaced apart from each other and mounted movably to said frame, each of said second blocking members having a blocking end portion disposed distal from said outlet in said frame, said second blocking members being operable so that said blocking end portions of said second blocking members move toward and away from each other;

when said blocking end portions of said first blocking members move toward each other, said one of the specifications received in said receiving space is blocked by said blocking end portions of said first blocking members;

when said blocking end portions of said first blocking members move away from each other while said blocking end portions of said second blocking members move toward each other, said one of the specifications received in said receiving space is released from said blocking end portions of said first blocking members, moves outwardly of said receiving space in said frame, and is blocked by said blocking end portions of said second blocking members; and when said blocking end portions of said second blocking members move away from each other, said one of the specifications is released from said blocking end portions of said second blocking members, thereby feeding said one of the specifications.

3. The specification-attaching apparatus as claimed in claim 2, wherein said specification-feeding unit further includes a set of first hydraulic cylinders mounted on said frame for driving said first blocking members, and a set of second hydraulic cylinders mounted on said frame for driving said second blocking members.

4. The specification-attaching apparatus as claimed in claim 2, further comprising a specification storage unit configured with an accommodating groove unit adapted for accommodating at least one row of specifications therein, and in spatial communication with said inlet in said frame of said specification-feeding unit such that the specifications received in said accommodating groove unit are supplied into said receiving space in said frame of said specification-feeding unit via said inlet in said frame.

5. The specification-attaching apparatus as claimed in claim 2, wherein said transferring unit includes:

a pivot arm having a pivot end connected pivotally to said frame of said specification-feeding unit, and a free end opposite to said pivot end, said pivot arm being operable so that said free end moves between the first position, and a second position adjacent to said outlet in said frame of said specification-feeding unit; and a second suction member mounted on said free end of said pivot arm and operable between a sucking state and a non-sucking state, wherein said second suction member is switched from the non-sucking state to the sucking state when said free end of said pivot arm is at the second position such that said one of the specifications fed from said specification-feeding unit is sucked thereby, and is switched from the sucking state to the non-sucking state when said free end of said pivot arm is at the first position while said first suction member of said attaching unit is at the sucking position such that said one of the specifications is released therefrom and is sucked by said first suction member of said attaching unit.

6. The specification-attaching apparatus as claimed in claim 1, wherein said attaching unit further includes:

an actuating member extending between the releasing position and the sucking position; and three sensors mounted spacedly on said pivot rod, angularly equidistant, and corresponding respectively to said first suction members of said attaching unit, each of said sensors being activated by said actuating member when a corresponding one of said first suction members of said attaching unit is at the releasing position, and being deactivated when the corresponding one of said first suction members of said attaching unit is at the sucking position;

each of said first suction members of said attaching unit being operated in the non-sucking state during activation of a corresponding one of said sensors and in the sucking state during deactivation of the corresponding one of said sensors.

* * * * *